United States Patent [19]

Treplin et al.

[11] 4,113,008

[45] Sep. 12, 1978

[54] APPARATUS FOR SEPARATING CLEANING ELEMENTS FROM A FLUID

[75] Inventors: Friedrich-Wilhelm Treplin, Ratingen; Werner Borchert, Ratingen-Tiefenbroich, both of Germany

[73] Assignee: Ludwig Taprogge, Reinigungsanlagen für Röhren-Wärmeaustauscher, Düsseldorf, Germany

[21] Appl. No.: 781,489

[22] Filed: Mar. 25, 1977

[30] Foreign Application Priority Data

Mar. 26, 1976 [DE] Fed. Rep. of Germany ..... 2612917

[51] Int. Cl.[2] ..... F28G 1/12

[52] U.S. Cl. ..... 165/95; 15/95; 51/424; 51/425

[58] Field of Search ..... 165/95; 122/395; 15/95; 51/424, 425

[56] References Cited

U.S. PATENT DOCUMENTS

| | | | |
|---|---|---|---|
| 948,270 | 2/1910 | Dreisbach | 51/424 |
| 2,621,446 | 12/1952 | Russell | 51/424 |
| 3,034,262 | 5/1962 | Powlson | 51/424 |
| 3,097,451 | 7/1963 | Freeman et al. | 51/425 |

*Primary Examiner*—Charles J. Myhre
*Assistant Examiner*—Theophil W. Streule, Jr.
*Attorney, Agent, or Firm*—Karl F. Ross

[57] ABSTRACT

An apparatus for separating cleaning elements from a fluid, especially a fluid traversing a heat exchanger into which the elements are introduced to clean the tubes thereof, comprises a vertical duct provided with an array of bars forming a grate inclined to the axis of the duct for separating the cleaning elenents, e.g. foam-rubber balls, from the heat exchanger stream traversing the duct. According to the invention, at the bottom of the grate there is provided a diagonal tube which extends along a chord or diameter of the tube and is provided with a longitudinally extending inlet slit into which the cleaning elements pass. The tube and slit are so oriented that the main stream of fluid passes tangentially across the tube and across the slit to create a turbulence thereat to prevent buildup of the cleaning elements at the base of the grate.

8 Claims, 3 Drawing Figures

APPARATUS FOR SEPARATING CLEANING ELEMENTS FROM A FLUID

FIELD OF THE INVENTION

The invention relates to an apparatus for separating cleaning elements from a fluid stream and, more particularly, to a device which can be inserted in the path of a stream traversing a tube heat exchanger for removing cleaning elements introduced into the main stream of fluid traversing this heat exchanger to form cleaning members scouring the interior of the heat exchanger tubes.

BACKGROUND OF THE INVENTION

For automatic cleaning of the tubes of a tube hear exchanger, the main stream of fluid traversing same can be charged with cleaning elements, e.g. foam-rubber balls, which are carried along with the main stream and scour the inner surfaces of the tube. It is necessary to recover the cleaning elements from the main stream downstream of the tubes and to recycle them to the oncoming main stream upstream of the tubes.

A system of this type is described, for example, in U.S. Pat. No. 3,021,117. Generally a device of this type for recovering the cleaning elements from the main stream comprises a vertically exposed cylindrical duct having a circular cross section and formed internally with a separating sieve or grate which is inclined to the axis of the duct so that the separating disk or sieve has a generally elliptical periphery.

In one arrangement of this type, (see German published application- Auslegeschrift DTAS No. 1,303,750), the separating device comprises a box-like housing provided on a horizontal lower edge of the separating sieve or grate and having a pair of parallel vertical side walls with grate-like members forming a wedge, i.e. converging toward one another. As a rule, two separating sieves are provided symmetrically to feed into the box-like discharge structure.

A problem has been found to arise with such systems in that the velocity of the gas must be carefully controlled to prevent accumulation of the particles, balls or other cleaning elements upon the grates and the jamming of the discharge device. This effect is especially pronounced at high throughflow velocities.

OBJECT OF THE INVENTION

It is the principal object of the present invention to provide an apparatus for separating cleaning elements or the like from a fluid stream whereby the system is more reliable than the earlier arrangements for this purpose, is free from the disadvantages of these earlier arrangements, and can remove the cleaning elements in a reliable and continuous manner practically at any velocity of the fluid stream traversing the duct.

SUMMARY OF THE INVENTION

This object and others which will become apparent hereinafter is attained, in accordance with the present invention, by providing a separating device or apparatus which comprises a vertically disposed cylindrical duct of circular cross section, and at least one inclined grate within this duct and having an ellipsoidal upper periphery, the grate being formed at its lower end with a diagonal tube having a discharge fitting. The diagonal tube, according to the invention, has a longitudinally extending slit which opens at the base of the grate and is so oriented (i.e. open laterally), that some of the main fluid stream flowing over the tube passes tangentially into the slit. As a result, the main stream of high intensity, generates an increasing turbulence or vortex flow which induces (sucks) the cleaning elements through the slit and, moreover, prevents accumulation of the elements upon the tube or at the base of the grate.

According to a feature of the invention, two such grates are provided in the duct in axially spaced and opposing relationship, one of the grates having its discharge tube lying above the discharge tube of the other grate. In this case, each of the separating sieves or grates is provided with a respective diagonal tube. The diagonal tubes can be parallel to one another and it is desirable to so dispose the diagonal tubes that they are offset in projection along the axis of the duct. The offset may be such that the slotted side of one of the tubes lies substantially directly above the unslotted side of the other tube and vice versa.

The term "tube" as used above is intended to refer preferably to a pipe of circular cross section, although the pipe may have noncircular cross section, or even nonround cross section at portions thereof, as long as the aforementioned turbulence or vortex is created.

The principal advantage of the system of the present invention is that the collecting structure, namely, the tube does not need to be provided with additional grates and hence the collecting structure can have an extremely simple configuration. Furthermore, because of the configuration of the tube and the orientation of the slit or slot, a suction is created at this slit or slot, i.e. the opening into the tube, so that the cleaning elements are drawn readily into the latter as they descend upon the grate. Buildup of the cleaning elements at the mouth of the tube is thus precluded.

Furthermore, when the mouth of the tube is tangential to the surface of the grate, there is no impediment in the passage of the cleaning elements into the tube and, moreover, the turbulence or vortex creates a swirl within the interior of the tube which keeps the cleaning elements loose as they are drawn from the collecting tube over the entire length of the slit and hence the tube.

It is also possible to spray water or an auxiliary liquid into the tube to promote the circular movement of the cleaning particles about the axis thereof.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 3:
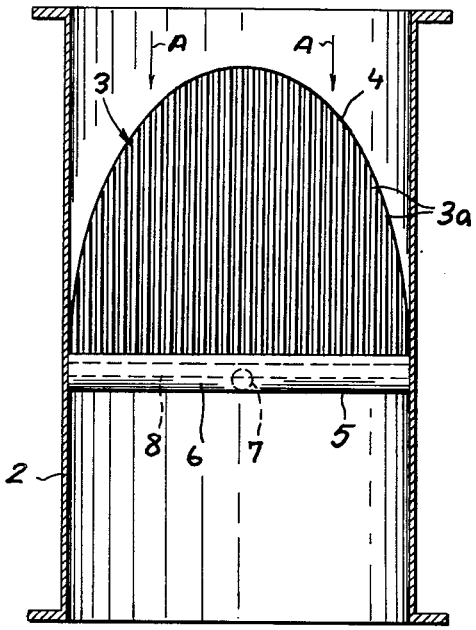
FIG. 3 is a section taken along the line III—III of FIG. 1.

The apparatus shown in the drawing comprises a vertically disposed cylindrical duct 2 which can be connected to the discharge side of a tube heat exchanger into which cleaning elements 1 are introduced. Cleaning elements 1 are foam-rubber balls as illustrated in FIG. 2.

Basically, the apparatus comprises the housing or duct 2 which is traversed axially and vertically in the direction of the arrows A by the main stream of fluid and entrained particles 1, and a pair of separating sieves or grates 3 built into the duct 2 and disposed in axially offset relationship therealong.

Each of the grates 3 has an upper elliptical boundary 4 and a horizontal lower boundary 5 lying substantially along a chord or diameter of the duct 2. At the base of each of the grates 3, i.e. along its lower boundary 5, there is provided a removing device for recovering the particles 1 and withdrawing them from the main stream of the fluid traversing the duct.

Figure 2:
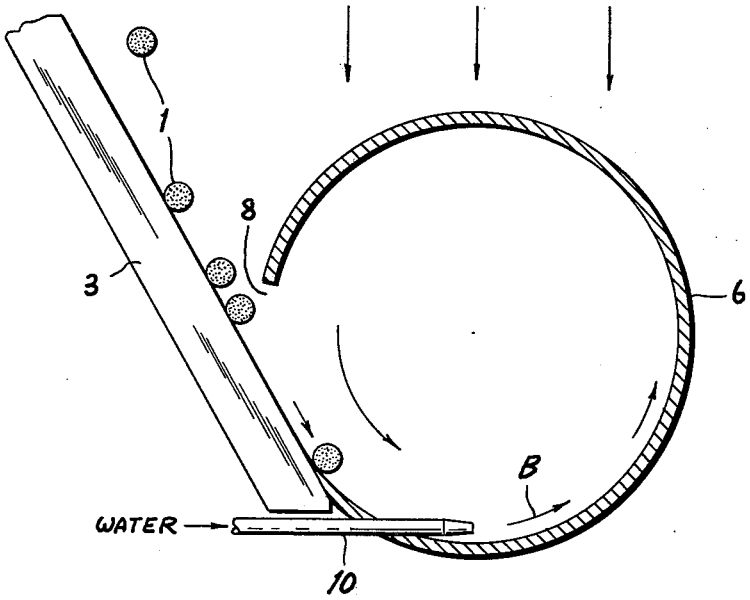
FIG. 2 is a detail view of the region II of FIG. 1, drawn to an enlarged scale.

As is especially apparent from FIGS. 2 and 3, the recovery device in each case comprises a diagonal tube 6 having a discharge fitting 7 connected to the tube generally centrally thereof and extending more or less radially out of the duct 2. A suction source can be connected to each of the fittings 7.

Each of the diagonal tubes 6, which lies along a chord of the duct 1, is provided with a longitudinally extending slit 8, the lower edge of which lies tangential to the plane of the grate 3 (see FIG. 2), the upper edge of each slit overhanging the lower edge thereof. As the fluid traverses the duct 2, it passes over the surface of the tube 6 (see FIG. 2) so that, at least in the region of the slit 8, is tangentially effective. As a result, the fluid enters the slit 8 substantially tangentially and induces a high velocity vortex therein as represented by the arrows B. This vortex sucks the particles 1 intensively into the slit 8 and carries the particles to the discharge fitting 7. Nozzles 10 can open into the tube 6 to inject water into the latter and thereby further promote the vortex formation.

Figure 1:
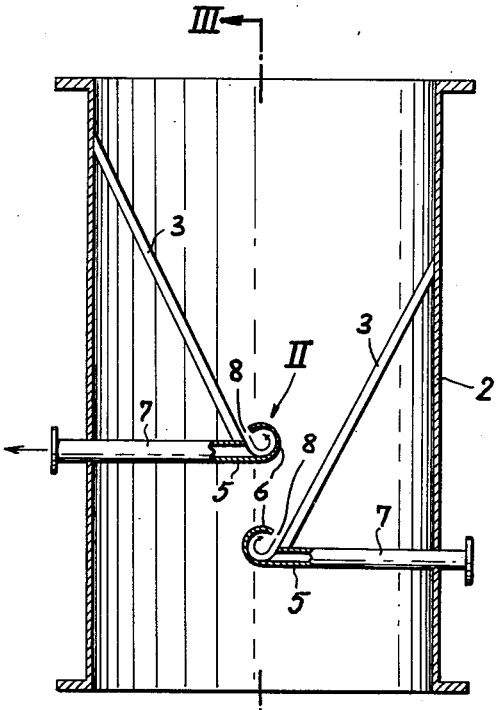
FIG. 1 is an axial cross section, in diagrammatic form, illustrating a separating device according to the invention.

As can be seen from FIG. 1, two such grates 3 are provided symmetrically to the axis of the duct 2, each of the grates 3 having a respective diagonal tube 6, the diagonal tube 6 being disposed parallel to one another and one above the other. The diagonal tubes 6 are, in an axial projection (i.e. in projection along the axis of the duct 2) offset from one another sufficiently that the aforedescribed turbulent or vortex flow can occur and the upstream diagonal tube cannot interfere with the vortex formation at the downstream tube. Furthermore, the upstream tube 6 can be omitted and the gap between the upper grate and the lower tube 6 bridged by additional bars of a further grate.

The grates 3 have bars 3*a* which lie in vertical planes as can be seen in FIG. 3. These bars are, however, inclined downwardly to the axis at an acute angle.

We claim:

1. An apparatus for separating cleaning elements from a fluid stream traversing a heat exchanger, said apparatus comprising a vertically disposed circular cylindrical duct;

at least one separating sieve disposed in said duct and lying in a plane inclined to the axis thereof, said sieve having an ellipsoidal upper boundary and a substantially horizontal lower boundary;

a diagonal collecting tube disposed along said lower boundary and formed with a longitudinally extending slit aligned with said lower boundary and receiving cleaning elements collected by said sieve, said slit extending over the entire lower boundary of said sieve and substantially the full length of said collecting tube, said slit being disposed so as to induce a tangential and swirling flow of the fluid axially, traversing said duct into said tube and entraining said cleaning elements from said sieve through said slit into said tube; and a fitting connected to said tube for withdrawing said elements therefrom.

2. The apparatus defined in claim 1 wherein said fitting extends substantially radially from said duct.

3. The apparatus defined in claim 2 wherein said fitting is connected to said tube substantially at the center thereof.

4. The apparatus defined in claim 3 wherein said sieve is a grate having a substantially parallel bars lying in respective vertical planes, said grate being inclined to the axis of said duct.

5. The apparatus defined in claim 4, further comprising a second grate disposed above said first grate and having an upper boundary formed a portion of an ellipse and a horizontal lower boundary, the latter horizontal lower boundary being offset from the lower boundary of the first mentioned grate in projection on a plane perpendicular to the axis of said duct.

6. The apparatus defined in claim 5 wherein said upper grate is formed with a collecting tube having a slit disposed so as to receive a tangential influx of said fluid.

7. The apparatus defined in claim 6, wherein said tubes are of circular cross section.

8. The apparatus defined in claim 7 wherein said tubes are so disposed that the relatively upstream tube does not impede the tangential flow of fluid into the relatively downstream tube.

* * * * *